US006602010B1

(12) United States Patent
Doyle et al.

(10) Patent No.: US 6,602,010 B1
(45) Date of Patent: Aug. 5, 2003

(54) LIQUID SOAP SPRAYER AND SPONGE ATTACHMENT FOR WATER SPRAYER

(76) Inventors: Karin Marie Doyle, 10530 W. Emerald Ave., Orland Park, IL (US) 60467; John Jeffery Oskorep, 416 W. Briar Pl. Unit #3, Chicago, IL (US) 60657

( * ) Notice: Subject to any disclaimer, the term of this patent is extended or adjusted under 35 U.S.C. 154(b) by 0 days.

(21) Appl. No.: 10/144,392

(22) Filed: May 10, 2002

(51) Int. Cl.[7] ..... B43K 5/00

(52) U.S. Cl. ..... 401/203; 401/289; 401/188 R; 401/261; 401/263

(58) Field of Search ..... 401/203, 289, 401/188 R, 261, 263, 265, 266; 15/29; 239/381; 222/566, 567

(56) References Cited

U.S. PATENT DOCUMENTS

| | | | | |
|---|---|---|---|---|
| 2,748,411 A | * | 6/1956 | O'Brien | 401/289 |
| 2,807,816 A | * | 10/1957 | O'Brien | 401/289 |
| 4,574,414 A | | 3/1986 | Zhadnov | |
| 4,812,070 A | | 3/1989 | Marty | |
| 4,971,471 A | * | 11/1990 | Sloan | 401/203 |
| 5,316,401 A | * | 5/1994 | Sears | 401/139 |
| 5,517,705 A | | 5/1996 | Jackson | |
| 5,588,160 A | | 12/1996 | Nichols | |
| 5,649,334 A | | 7/1997 | Henriquez et al. | |
| 5,906,319 A | | 5/1999 | Crowl | |
| 5,964,003 A | | 10/1999 | Rogers | |
| 6,000,626 A | | 12/1999 | Futo et al. | |
| 6,035,477 A | | 3/2000 | Robert | |
| 6,270,278 B1 | * | 8/2001 | Mauro | 401/289 |

* cited by examiner

*Primary Examiner*—David J. Walczak
(74) *Attorney, Agent, or Firm*—John J. Oskorep, Esq.

(57) ABSTRACT

A low-cost, simple, and easy-to-use liquid soap spraying and sponge attachment for a water sprayer. The attachment includes a tubular body which forms a cavity having a first open end on the front side and a second open end on the rear side. The second open end is configured to receive the nozzle portion of the water sprayer while exposing the actuator and the handle portion of the water sprayer. The first open end is configured to allow water from the nozzle portion of the water sprayer to spray through the body in response to actuations of the actuator. A detachable circular sponge is positioned on the front side of the body, preferably using Velcro materials. A liquid soap spraying mechanism of the attachment includes a liquid soap reservoir formed within the tubular body, a liquid soap pump mechanism in the body, a liquid soap nozzle positioned on the front side of the body, and a finger trigger lever positioned on the bottom rear side of the tubular body for spraying liquid soap from the liquid soap nozzle when actuated. Thus, single-handed operation is possible wherein the end-user's hand can move the water sprayer to position the sponge for scrubbing, the user's thumb can activate the water sprayer for spraying water, and the user's index finger can activate the soap sprayer for spraying soap.

22 Claims, 4 Drawing Sheets

-- PRIOR ART --

-- PRIOR ART --

LIQUID SOAP SPRAYER AND SPONGE ATTACHMENT FOR WATER SPRAYER

BACKGROUND OF THE INVENTION

1. Field of the Invention

The present invention relates generally to cleaning apparatus for dishes and the like, and more particularly to a cleaning attachment for a conventional water sprayer.

2. Description of the Related Art

Prior art cleaning devices for the kitchen sink are not easy to use. Conventional sponges require that a user hold onto a plate/cup with one hand and the sponge with the other. When a conventional high-pressure water sprayer is utilized, however, it is difficult if not impossible to hold onto the water sprayer and sponge simultaneously in an effective manner. Typically, the conventional water sprayer is attached to a hose for water supply and is positioned on one side of the sink. Other conventional cleaning devices, such as a combined sponge and liquid soap device, provides the convenience of both a sponge and soap in one hand. Again, however, it is difficult to use this cleaning device along with the water sprayer without juggling the items from hand to hand.

The closest known prior art relating to the present invention of which the inventors are aware is described in U.S. Pat. No. 6,035,477 (the '477 patent). In the '477 patent, a cleaning apparatus which attaches to a conventional water sprayer is described. Although the cleaning apparatus in the '477 patent is useful for one-handed cleaning operation in some cases, it is deficient in several respects and substantially different from the cleaning attachment described herein. For one, the cleaning device of the '477 patent is generally not a simple attachment; it appears both relatively costly from a manufacturing point of view and intimidating to install. In addition, since it uses a large body to encapsulate the water sprayer, it is not sized appropriately to clean all kitchen items such as the insides of glasses. Also, soap is merely dispensed into the sponge which is undesirable because a user does not know or appreciate how much soap is being dispensed. Finally, the sponge appears inconvenient to replace or exchange on-the-fly.

Accordingly, what is needed is a cleaning attachment for a conventional water sprayer that is simple, low-cost, and easy to use.

SUMMARY OF THE INVENTION

A simple, low-cost, and easy-to-use liquid soap spraying and sponge attachment for a conventional high-pressure water sprayer is disclosed. The attachment is suitable for the conventional water sprayer which has a nozzle portion and a handle portion transversely extending therefrom with a hose extending from the handle portion for supplying water and for spraying water through use of an actuator located on the handle portion.

In one illustrative embodiment, the attachment includes a tubular body which forms a cavity having a first open end on a front side of the tubular body and a second open end on a rear side of the tubular body. The second open end is configured to receive the nozzle portion of the water sprayer while exposing the actuator and the handle portion. The first open end is configured to allow water from the nozzle portion of the water sprayer to spray through the body in response to actuations of the actuator. A detachable circular sponge with a hole in its center is positioned on the front side of the body. A liquid soap spraying mechanism is also provided in the attachment and includes a liquid soap reservoir formed within the tubular body, a liquid soap pump mechanism in the body, a liquid soap nozzle positioned on the front side of the body, and an index finger trigger lever positioned on a bottom rear side of the tubular body for spraying liquid soap from the liquid soap nozzle when actuated.

Thus, easy single-handed operation is possible, wherein the user's hand can hold onto and move the water sprayer to position the sponge for scrubbing, the user's thumb can activate the water sprayer for spraying water, and the user's index finger can activate the soap sprayer for spraying soap onto the item to be cleaned. Sponges can be easily replaced and exchanged, especially when the sponges are attached using Velcro™.

DETAILED DESCRIPTION OF THE PREFERRED EMBODIMENTS

Figure 1:
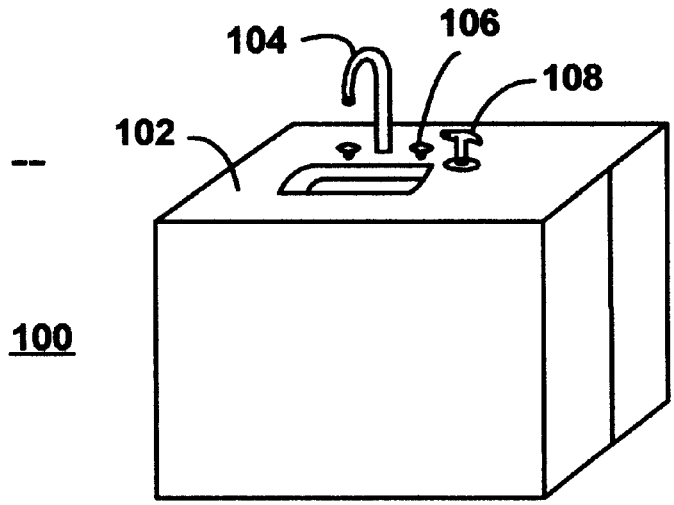
FIG. 1 is an illustration of a kitchen sink around which the present invention may be utilized.
Figure 2:
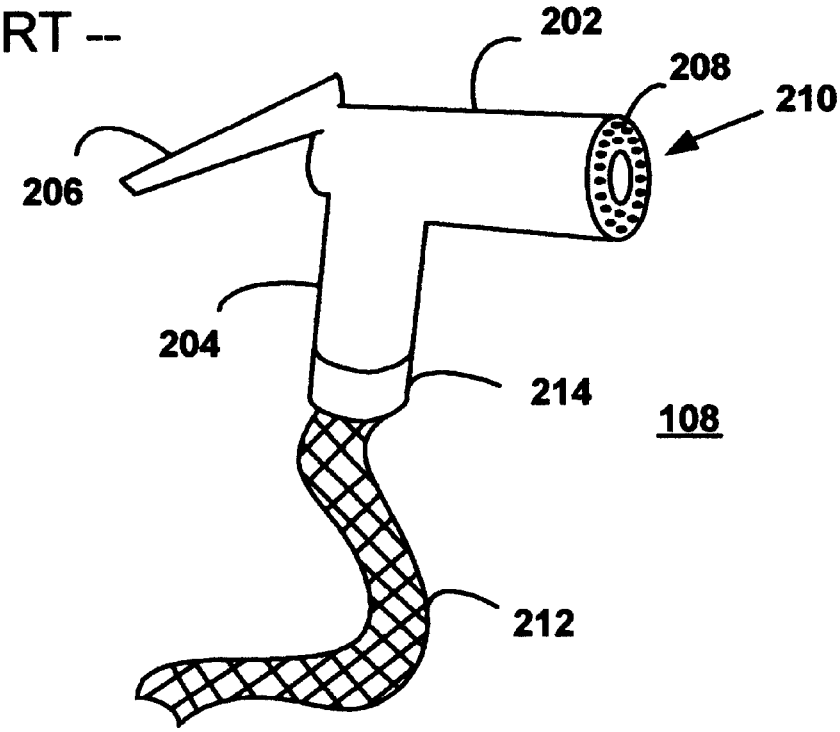
FIG. 2 is an illustration of a conventional water sprayer which may receive the inventive cleaning attachment.

FIG. 1 is an illustration of a kitchen sink 100, the environment in which the present invention may be utilized. A sink countertop 102 has a faucet 104 and a water knob 106 which, when turned, lets low-pressure water out of faucet 104. A conventional water sprayer 108 is typically positioned on one side of the sink. Water sprayer 108 provides the ability to spray high-pressure water when water knob 106 is turned and the spray handle of water sprayer 108 is pressed. Water sprayer 108 is shown in more detail in FIG. 2. The body of water sprayer 108 is formed from a horizontal tubular member 202 which meets with a vertical tubular member 204. A front end 210 of horizontal tubular member 202 includes a nozzle 208 which has a plurality of holes from which water sprays. The bottom of vertical tubular member 204 meets with a hose 212 through a connecting interface 214.

Figure 5:
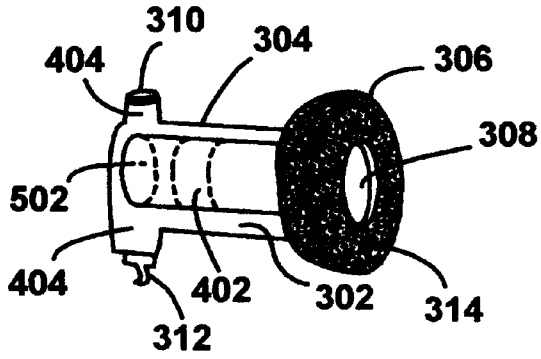
FIG. 5 is another partial transparent view of the cleaning attachment without being attached to the water sprayer.

FIG. 5 is an illustration of a cleaning attachment 302 in a partial transparent view. Cleaning attachment 302 has a tubular body 304 which forms a cylindrical hollow tunnel 402. Body 304 may be made of any suitable material, such as a hard plastic. Holes 308 and 502 lead into and out of hollow tunnel 402 on a front end and a rear end, respectively, of body 304. Hole 502 is sized to receive the nozzle portion of the water sprayer. Preferably, hollow tunnel 402 is sized to provide a snug fit around the water sprayer when it receives the nozzle portion thereof. Other suitable attachment means may also be provided, such as an elastic band that is attached to the rear end of body 304 and used for wrapping around the handle portion of the water sprayer, or a clamping piece to secure the body to the sprayer.

A circular sponge 306 is attached to the front end of body 304 such that a central circular hole of sponge 306 is concentric with hole 308 of body 304. Sponge 306 may be soft and spongy or, alternatively, abrasive or brush-like. A liquid soap reservoir 404 is formed within body 304, and a cap 310 covers a pouring hole through which liquid soap may be poured into reservoir 404. A dispensing hole 314 is formed on the front side of body 304 and leads into reservoir 404. A trigger lever 312 is positioned on the rear side and bottom of body 302 and, when actuated, causes the liquid soap in reservoir 404 to be dispensed out of dispensing hole 314.

Figure 3:
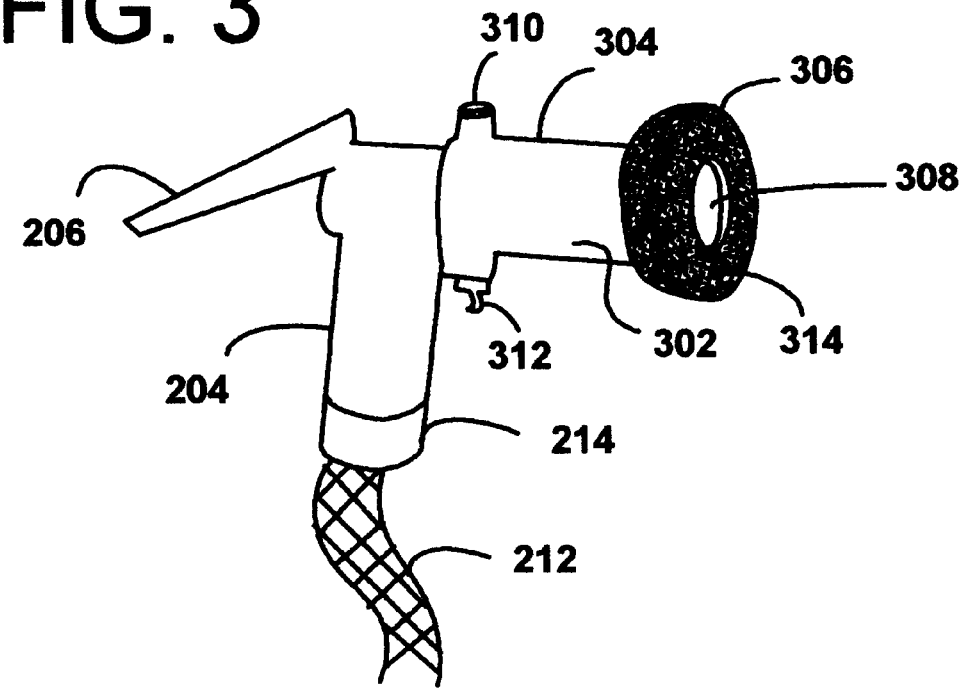
FIG. 3 is an illustration of the inventive cleaning attachment which is shown attached to the water sprayer of FIG. 2.
Figure 4:
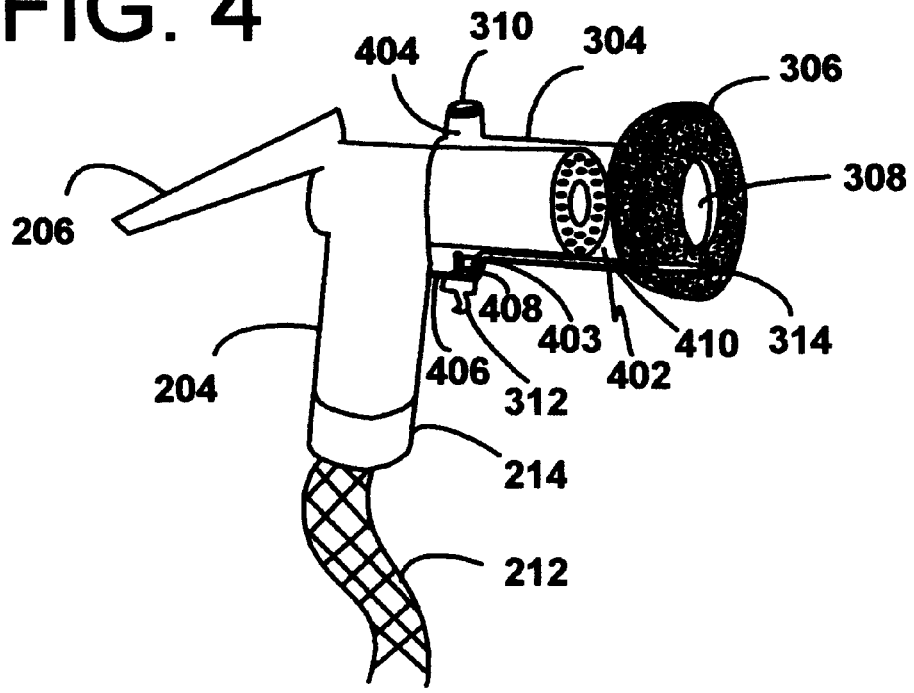
FIG. 4 is a partial transparent view of the cleaning attachment shown attached to the water sprayer.

In FIGS. 3 and 4, cleaning attachment 302 is shown attached to water sprayer 108 in solid and partially transparent views, respectively. In FIG. 4, trigger lever 312 is shown as being movably disposed on a track 406 which is formed on body 304. A first tube 403 is attached to a pump 408, which is attached to a second tube 410 leading to dispensing hole 314. In this embodiment, the trigger or dispensing mechanism is the same as that utilized in a conventional cleaner spray bottle or conventional water squirt gun.

As apparent, a user of water sprayer 108 and attachment 302 can hold member 204 of water sprayer 108 in a conventional fashion, use his/her thumb to press spray handle 206 to spray water out of water sprayer 108 in a conventional fashion, and use his/her index finger to press spray trigger 312 towards member 204 to spray liquid soap out of attachment 302. Preferably, the body has an thin extension piece behind trigger 312 which extends downwardly along handle 206 such that the user can wrap his/her fingers around the extension piece to secure the body to sprayer 108 when in use.

Figure 6:
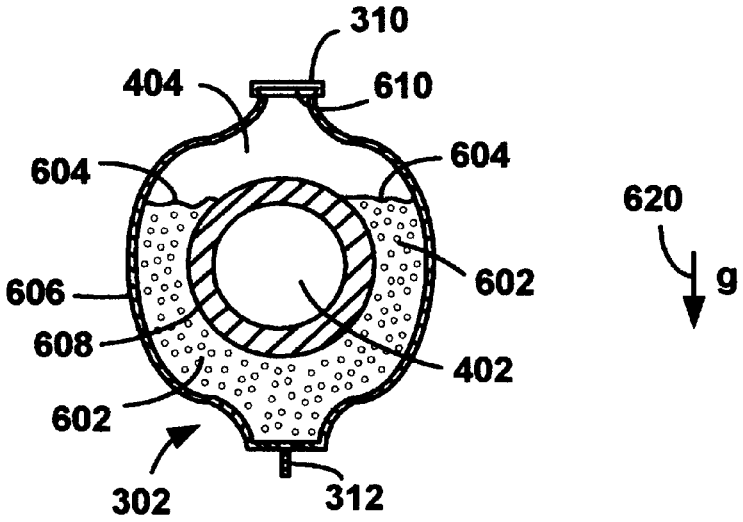
FIG. 6 is a cross-sectional view of the cleaning attachment shown in FIG. 5.
Figure 7:
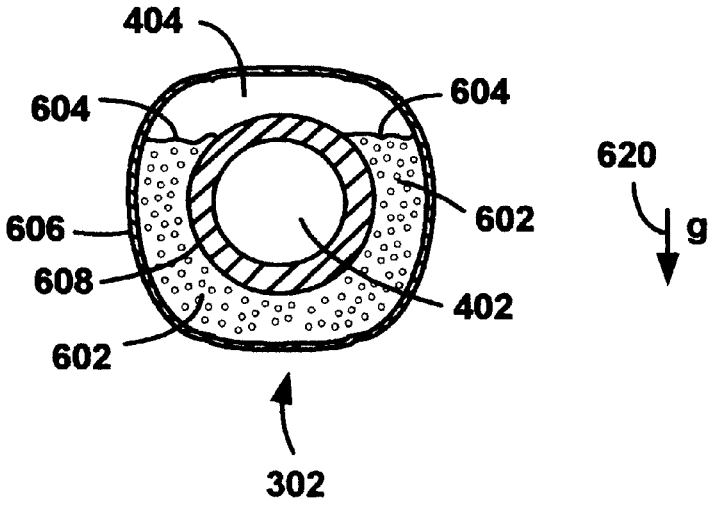
FIG. 7 is another cross-sectional view of the cleaning attachment shown in FIG. 5.

FIGS. 6 and 7 show two different cross-sectional views of cleaning attachment 302. In these figures, liquid soap 602 is shown as being held within reservoir 404 between body walls 606 and 608 below a pouring hole 610 covered by cap 310. Reservoir 404 is shown as not being completely full; in fact, reservoir 404 as shown is only about ¾ full as is revealed by the surface 604 of liquid soap 602. An arrow 620 shows the direction of gravitational forces on liquid soap 602. These gravitational forces keep liquid soap at the bottom of reservoir 404 so that the end of the tube may pull liquid soap 602.

Figure 8:
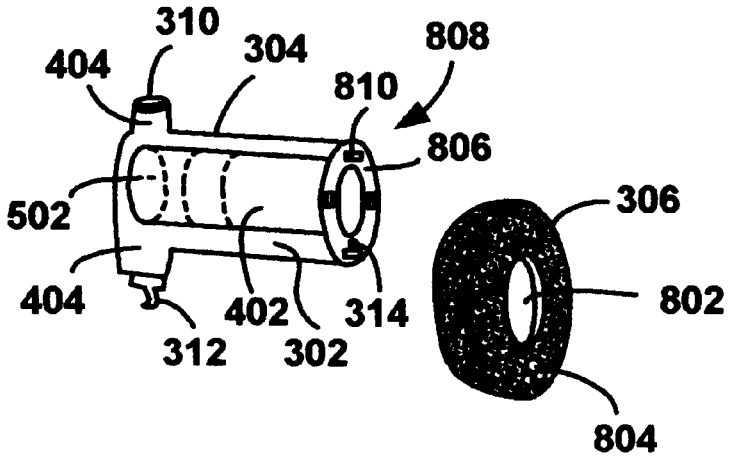
FIG. 8 is an illustration of the cleaning attachment with the sponge removed.

FIG. 8 shows another partially transparent view of cleaning attachment 302 where sponge 306 is shown detached from body 304. As shown, sponge 306 is circular and has a circular hole 802 and another circular hole 804 through which liquid soap sprays. A front surface of body 304 has a plurality of VELCRO™ strips 808 (i.e. hook and loop fasteners), such as a VELCRO strip 810, attached thereto. The strips 808 may be attached via an adhesive or other suitable means. Similarly, a rear side of sponge 306 has a plurality of complementary VELCRO strips (not visible) which will adhere to the plurality of VELCRO strips 808 on body 304.

Figure 9:
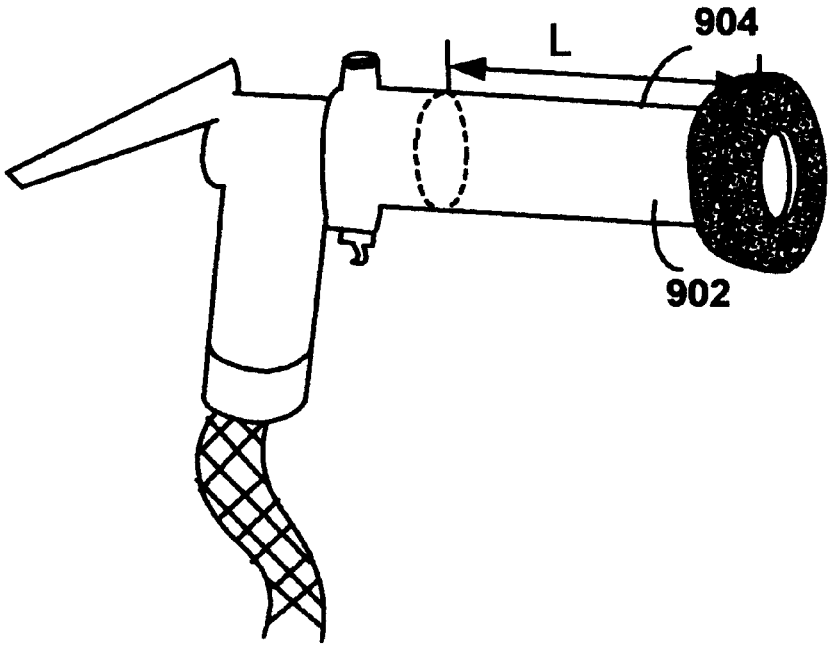
FIG. 9 is an illustration of the cleaning attachment having a suitable length for cleaning the insides of cups and glasses.

FIG. 9 shows a variation of the cleaning attachment which has a longer length that shown and described in relation to FIGS. 3, 4, and 5. In this embodiment, cleaning attachment 902 has a tubular body 904 which has a length of at least 3 inches, and preferably between 3.5 and 5.5 inches. Preferably, the cross-section of the front end of the body has a width or diameter of no greater than 2 inches and the circular sponge has a diameter of no greater than 3 inches. Such dimensions are suitable for cleaning the insides of glasses, cups, and similar items.

Advantageously, cleaning attachment 302 is a low-cost device which greatly assists a user in cleaning dishes, glasses, etc. It can be easily attached to and detached from a conventional water sprayer when needed—it is not intimidating to install or use. Cleaning attachment 302 allows for simple one-handed operation, while the dish, glass, etc. can be held with the other hand. Sponge 306 is easily attachable to and detachable from body 304. Since it is largely a conventional sponge with a donut-like shape, sponge 306 is low-cost and easily manufactured. Body 304 is preferably long and narrow so that the insides of glasses and cups may be cleaned.

It is to be understood that the above is merely a description of preferred embodiments of the invention and that various changes, alterations, and variations may be made without departing from the true spirit and scope of the invention as set for in the appended claims. For example, one skilled in the art will understand that the attachment may be suitably sized for use with newer conventional water sprayers which pull out from the primary central kitchen faucet None of the terms or phrases in the specification and claims has been given any special particular meaning different from the plain language meaning to those skilled in the art, and therefore the specification is not to be used to define terms in an unduly narrow sense.

What is claimed is:

1. A cleaning attachment for a water sprayer, the water sprayer having a nozzle portion and a handle portion transversely extending therefrom with a hose extending from the handle portion for supplying water thereto and for spraying water through use of an actuator located on the handle portion, the cleaning attachment comprising:

a tubular body having:

a rear opening on a rear end of the body for receiving the nozzle portion of the water sprayer while exposing the actuator and the handle portion thereof;

a front opening on a front end of the body for allowing water from the nozzle portion of the water sprayer to spray through the body in response to actuations of the actuator;

a scrubber attached to the front side of the body;

a soap spraying mechanism which includes:

a liquid soap reservoir;

a soap pump mechanism in the reservoir;

a liquid soap nozzle exposed on the front end of the body and connected to the soap pump mechanism; and a finger trigger lever movably disposed on a bottom of the rear end of the body for spraying liquid soap from the liquid soap nozzle when actuated.

2. The cleaning attachment of claim 1, wherein the scrubber comprises a sponge.

3. The cleaning attachment of claim 1, wherein the scrubber is substantially circular and has a central hole which is concentric with the front opening.

4. The cleaning attachment of claim 1, wherein the scrubber comprises a sponge which is detachably mounted to the front end of the body with a hook and loop fastener.

5. The cleaning attachment of claim 1, wherein the tubular body comprises a cylindrical tubular body having a length of at least 3 inches.

6. The cleaning attachment of claim 1, wherein the front end has a width or diameter of no greater than 2 inches.

7. The cleaning attachment of claim 1, wherein the front end has a width of diameter of no greater than 2 inches, and the scrubber has a diameter of no greater than 3 inches.

8. The cleaning attachment of claim 1, wherein the finger trigger lever comprises an index finger trigger lever.

9. The cleaning attachment of claim 1, wherein the rear opening is configured to provide a snug fit for the nozzle portion of the water sprayer when received therethrough.

10. A cleaning attachment for a water sprayer, the water sprayer including a nozzle portion and a handle portion transversely extending therefrom with a hose extending from the handle portion for supplying water thereto and for spraying water through use of an actuator located on the handle portion, the cleaning attachment comprising:

a cylindrical tubular body having:

a rear end which has a first opening for receiving the nozzle portion of the water sprayer while exposing the actuator of the water sprayer;

a front end which has a second opening for allowing water from the nozzle portion of the water sprayer to spray through the body in response to actuations of the actuator; and a soap spraying mechanism which includes:

a liquid soap reservoir;

a soap pump mechanism;

a liquid soap nozzle hole exposed on the front end of the body; and a finger trigger lever movably disposed on a bottom of the rear end of the body for spraying liquid soap from the liquid soap nozzle when actuated.

11. The cleaning attachment of claim 10, further comprising:

a scrubber on the front side of the body.

12. The cleaning attachment of claim 10, further comprising:

a circular sponge having a central hole which is concentric with the second opening.

13. The cleaning attachment of claim 10, further comprising:

a circular sponge having a central hole which is concentric with the second opening and detachably mounted to the front end of the body with a hook and loop fastener.

14. The cleaning attachment of claim 10, wherein the first opening is sized and configured to provide a snug fit for the nozzle portion of the water sprayer when received therethrough.

15. The cleaning attachment of claim 10, wherein the cylindrical tubular body has a length of at least 3 inches.

16. The cleaning attachment of claim 10, wherein the front end has a width or diameter of no greater than 2 inches.

17. The cleaning attachment of claim 10, wherein the front end has a width of diameter of no greater than 2 inches, and the cleaning attachment further comprises a circular sponge which has a diameter of no greater than 3 inches and a central hole concentric with the second opening.

18. A cleaning attachment for a water sprayer, comprising:

a cylindrical tubular body having:

a first opening on a front end of the body;

a second opening on a rear end of the body;

the second opening configured to receive a nozzle portion of the water sprayer while exposing an actuator of the water sprayer;

the first opening configured to allow water from the nozzle portion of the water sprayer to spray through the body in response to actuations of the actuator;

the front end having at least a first hook and loop fastener strip positioned thereon;

a circular sponge positioned on the front end of the body and having a central hole which exposes the first opening on the body, the circular sponge having at least a second hook and loop fastener strip positioned on a rear side thereof for meeting with the at least a first hook and loop fastener strip on the front end of the body;

a liquid soap spraying mechanism, including:

a liquid soap reservoir formed within the body;

a liquid soap pump mechanism;

a liquid soap nozzle hole; and an index finger trigger lever positioned on a bottom of the rear end of the body for spraying liquid soap from the liquid soap nozzle when actuated.

19. The cleaning attachment of claim 18, wherein the second opening is sized and configured to provide a snug fit for the nozzle portion of the water sprayer when received therethrough.

20. The cleaning attachment of claim 18, wherein the second opening is configured to receive the nozzle portion of the water sprayer while exposing both the actuator and the handle portion of the water sprayer.

21. The cleaning attachment of claim 18, wherein the front end has a width or diameter of no greater than 2 inches.

22. The cleaning attachment of claim 18, wherein the front end has a width of diameter of no greater than 2 inches, and the circular sponge has a diameter of no greater than 3 inches.

* * * * *